United States Patent [19]

Föhl

[11] 4,125,142

[45] Nov. 14, 1978

[54] SAFETY DEVICE PROTECTING ROLLER BLINDS AGAINST UNROLLING

[75] Inventor: Artur Föhl, Haubersbronn, Germany

[73] Assignee: Repa Feinstanzwerk GmbH, Alfdorf, Germany

[21] Appl. No.: 831,801

[22] Filed: Sep. 9, 1977

Related U.S. Application Data

[63] Continuation of Ser. No. 692,274, Jun. 3, 1976, abandoned.

[30] Foreign Application Priority Data

Jun. 3, 1975 [DE] Fed. Rep. of Germany ..... 2524422

[51] Int. Cl.[2] ..... E06B 9/208

[52] U.S. Cl. ..... 160/291; 160/300

[58] Field of Search ..... 160/7, 8, 9, 291, 296, 160/300

[56] References Cited

U.S. PATENT DOCUMENTS

| | | | |
|---|---|---|---|
| 201,023 | 3/1878 | Lake | 160/296 |
| 826,284 | 7/1906 | Smith et al. | 160/296 |
| 1,709,305 | 4/1929 | Brunst et al. | 160/7 |

*Primary Examiner*—Peter M. Caun

*Attorney, Agent, or Firm*—Herbert L. Lerner

[57] ABSTRACT

A roller blind with a safety device for arresting accidental unrolling of the blind in which a shaft butt is coupled to one end of the winding shaft, a drive disk disposed on the shaft butt, a pawl shaped inertial member pivotally mounted on a pin extending from the drive disk, and a housing having internal teeth, around the disk and inertial member. The inertial member will not change its position relative to the drive disk but with increased unrolling velocity does change its position and the pawl engages the internal teeth of the housing to arrest unrolling of the blind.

5 Claims, 3 Drawing Figures

SAFETY DEVICE PROTECTING ROLLER BLINDS AGAINST UNROLLING

This is a division of application Ser. No. 692,274, filed June 3, 1976, now abandoned.

CROSS-REFERENCE TO RELATED APPLICATION

My cofiled U.S. application Ser. No. 692,275, now abandoned entitled "Safety Device for Arresting Unrolling of Roller Blinds".

BACKGROUND OF THE INVENTION

1. Field of the Invention

This invention relates to roller blinds with a horizontally oriented winding shaft and more particularly refers to a blind with a safety device which blocks the winding shaft in the event of a failure of the support or driving means and arrests unrolling.

2. Description of the Prior Art

Rolling gates and roller blinds with horizontal winding shafts, hereinafter collectively referred to as roller blinds, are known in the art. Unfortunately, failure of the driving mechanism or other support controlling the unrolling of the blind would occur with the result that the blind would make a rapid descent attaining considerable gravitational momentum placing great stress on the parts of the roller blind and often causing appreciable damage to it.

The known safety devices to arrest the winding shaft of the roller blindrely on the use of centrifugal force, which depends on the speed of rotation of the shaft, and requires that it reach a predetermined value which exceeds that of the normal unrolling speed. A necessary condition for this safety device to respond is therefore a sufficient height of fall of the roller blind, that is a height required for the build-up of the necessary centrifugal forces. However, this necessary falling distance which is considerable may already lie in the danger range. In addition, the safety device can be damaged or destroyed by the gravitational momentum of the already unrolled portion of the roller blind.

SUMMARY OF THE INVENTION

An object of the invention is to provide a roller blind having a horizontal winding shaft with a safety device which responds to the angular velocity of the winding shaft, independently of the centrifugal force.

With the foregoing and other objects in view, there is provided in accordance with the invention, a roller blind with a horizontally oriented winding shaft, a safety device for arresting unrolling of the blind in the event of failure of support means for the blind, which includes a shaft butt coupled to one end of the winding shaft to prevent rotation of the shaft butt relative to the winding shaft, at least one drive disk disposed on the shaft butt which drive disk rotates with the shaft butt, a bearing pin parallel to the axis of the shaft butt extending from the peripheral region of the drive disk, a pawl shaped inertial member pivotally mounted on the bearing pin which is concentric to the center of gravity and perpendicular to the lateral surfaces of the inertial member and a housing having internal teeth in which is disposed the shaft butt with the drive disk and pivotally mounted inertial member whereby when the roller blind is rolled down in normal operation the inertial member will not change its position relative to the drive disk, but with increased unrolling velocity the inertial member in the form of a pawl will change its position relative to the drive disk and engage the internal teeth of the housing to arrest unrolling of the blind.

BRIEF DESCRIPTION OF THE DRAWINGS

Other features which are considered as characteristic for the invention are set forth in the appended claims.

Although the invention is illustrated and described herein as embodied in safety device protecting roller blinds against unrolling, it is nevertheless not intended to be limited to the details shown, since various modifications and structural changes may be made therein without departing from the spirit of the invention and within the scope and range of equivalents of the claims.

Figure 1:
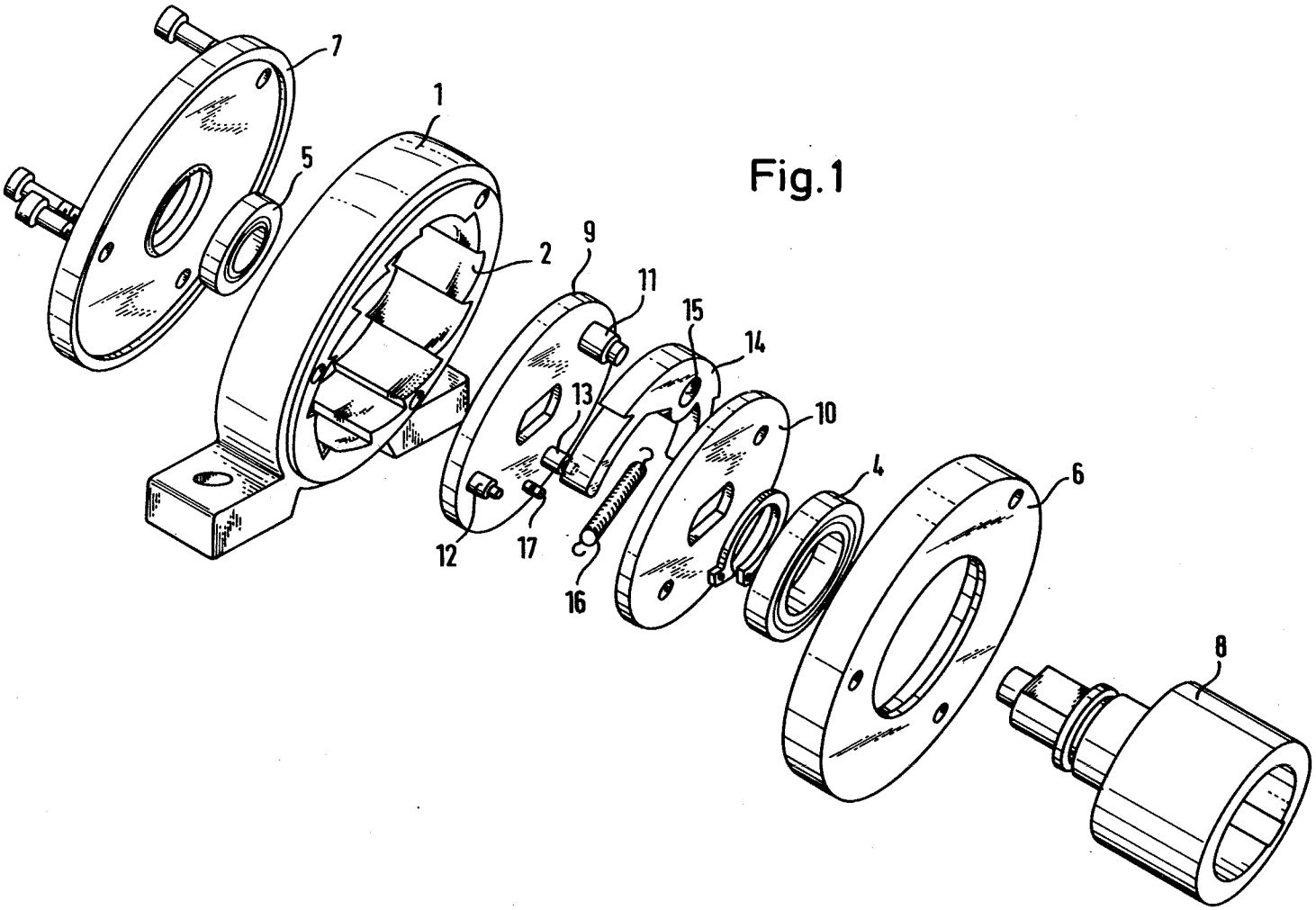
Figure 3:
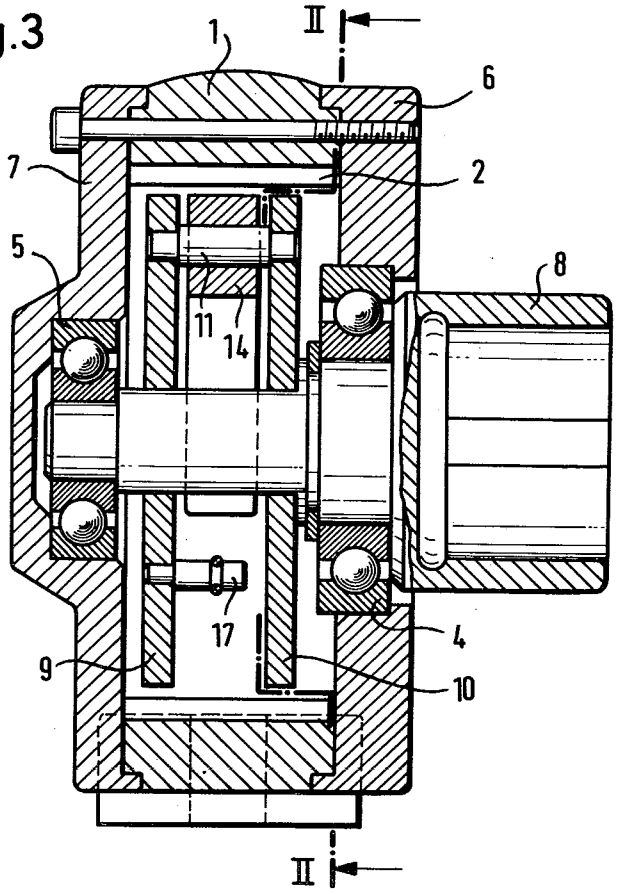
Figure 2:
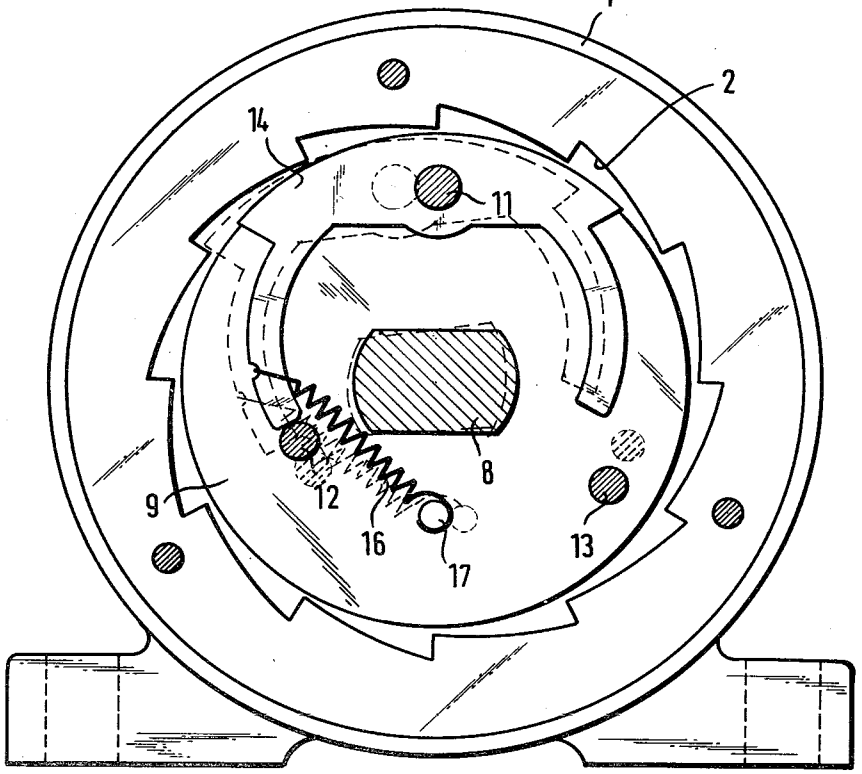

The construction and method of operation of the invention, however, together with additional objects and advantages thereof will be best understood from the following description when read in connection with the accompanying drawings, in which:

FIG. 1 shows an exploded view of the safety device of the roller blind;

FIG. 2 is a longitudinal cross-sectional view of the safety device of the roller blind; and FIG. 3 is a cross-sectional view along line II—II of FIG. 2.

DETAILED DESCRIPTION OF THE INVENTION

In accordance with the invention, a stationary housing which has internal teeth has disposed therein and supports a shaft butt coupled to the winding shaft and secured thereto to prevent rotation relative to it. At least one drive disk is placed on the shaft butt and the drive disk carries, pivoted in the peripheral region on a bearing pin oriented parallel to the shaft, an inertial member which is designed as a locking pawl, which interacts with the internal teeth of the housing. The pivot bearing is disposed perpendicularly to the lateral surfaces of the internal member and concentrically to its center of gravity.

With the arrangement according to the invention, a safety device against unrolling is obtained, which does not interfere with rolling-down of roller blinds in normal operation and which responds without material delay if the support or drive means acting on the winding shaft fails.

Tests have shown that a safety device designed in accordance with the invention responds to an angle of rotation which corresponds to one tooth pitch of the internal teeth upon an increase of the angular velocity, i.e. that in the case of danger, less than one-quarter of a revolution of the winding shaft, depending on the tooth pitch, is sufficient to ensure that the winding shaft is safely arrested. In this range, however, the gravitational momentum of the unrolled portion of the roller blind is quite small so that the forces to be taken up by the safety device are likewise very small and therefore, the mechanical stress on the parts of the safety device remains small.

According to one preferred embodiment of the invention, the inertial member is held, in normal operation, in its rest position by the force of a spring, which spring force, however, is made so small that, in the case of danger, the inertial effect predominates. Unintentional release of the safety device against unrolling can be prevented by a checking device such as a detent or a pawl, which holds the inertial member in the locking position after the safety device has responded.

Advantageously, the housing which has the internal teeth is designed so that it is usable as a bearing stand or pillow block for the winding shaft. Further, the housing is preferably of symetrical configuration with openings on both sides to permit the elements of the safety device to be inserted from the one or the other side as desired.

In the case of extremely heavy roller blinds, it may be advantageous to provide an energy converter, e.g., a friction clutch, between the safety device and the winding shaft.

Referring now to the drawings, the safety device against unrolling shown in the embodiment example is composed of a stationary housing 1 designed as a pillow block, which has internal teeth 2 and which can be closed off laterally by covers 6, 7 containing bearings 4, 5. A shaft butt 8 is supported in the bearings 4, 5, which shaft butt is connected so as to be secure against relative rotation, to the winding shaft, not shown, of a roller blind. Two drive disks 9, 10 are mounted on shaft butt 8 and likewise secured against relative rotation and placed within the housing. The drive disks 9, 10 are connected to each other by spacer posts 11, 12, 13, the spacer post 11 serving as the pivot bearing for an inertial member 14 with a locking pawl interacting with the internal teeth 2. Inertial member 14 has a bearing hole 15 coaxial to its center of gravity and perpendicular to its lateral surfaces.

A spring 16, which is attached at one end to a pin 17, holds the inertial member 14 in the rest position, shown in solid lines in FIG. 2. The inertial member 14 in the arresting or locking position is shown in dotted lines in FIG. 2. In rolling down a rolling gate or a roller blind in normal operation, the inertial member 14 will not change its position relative to the drive disks 9, 10. However, if an increased unrolling velocity occurs such as is the case, for example, if the support or drive means fail, then the inertial member 14 is forced by the force vector extending perpendicularly to its line of gravity into the position shown by broken lines in FIG. 2 and thereby, the winding shaft is blocked via the shaft butt 8 which is connected thereto.

We claim:

1. In a roller blind with a horizontally oriented winding shaft, a safety device for arresting unrolling of the blind in the event of failure of support means for the blind, which comprises a shaft butt coupled to one end of the winding shaft to prevent rotation of the shaft butt relative to the winding shaft, at least one drive disk disposed on said shaft butt which drive disk rotates with said shaft butt, a bearing pin parallel to the axis of the shaft butt extending from the peripheral region of said drive disk, a pawl shaped inertial member pivotally mounted on said bearing pin which is concentric to the center of gravity and perpendicular to the lateral surfaces of said inertial member, and a housing having internal teeth in which is disposed the shaft butt with the drive disk and pivotally mounted inertial member whereby when said roller blind is rolled down in normal operation said inertial member will not change its position radially relative to said drive disk, but with increased unrolling velocity said inertial member in the form of a pawl will change its position radially relative to said drive disk and engage the internal teeth of said housing to arrest unrolling of the blind.

2. In a roller blind with a safety device according to claim 1, wherein said inertial member is in normal operation held in its rest position by a spring.

3. In a roller blind with a safety device according to claim 1, wherein said inertial member is held in its arrested position by a checking device.

4. In a roller blind with a safety device according to claim 1, wherein said housing also serves as a pillow block for said winding shaft.

5. In a roller blind with a safety device according to claim 1, wherein said housing is symmetrical to permit insertion and assembly on the left or the right side of the housing as desired of the elements interacting with the housing including the shaft butt, drive disk, bearing pin, and the inertial member.

* * * * *